US006960118B2

(12) United States Patent
Aoki

(10) Patent No.: US 6,960,118 B2
(45) Date of Patent: Nov. 1, 2005

(54) SURFACE ROUGHENING TREATMENT METHOD OF OBJECT BEING TREATED, AND APPARATUS THEREFOR

(76) Inventor: Motohisa Aoki, 22-8-201, Funabashi 6-chome, Setagaya-ku, Tokyo (JP)

( * ) Notice: Subject to any disclaimer, the term of this patent is extended or adjusted under 35 U.S.C. 154(b) by 436 days.

(21) Appl. No.: 10/307,726

(22) Filed: Dec. 2, 2002

(65) Prior Publication Data

US 2003/0153249 A1 Aug. 14, 2003

(30) Foreign Application Priority Data

Feb. 13, 2002 (JP) ..... 2002-035761
Nov. 15, 2002 (JP) ..... 2002-332258

(51) Int. Cl.[7] ..... B24B 1/00
(52) U.S. Cl. ..... 451/39; 451/36; 451/38; 451/75; 451/76; 451/80; 451/82; 451/89; 451/93
(58) Field of Search ..... 481/36, 38, 39, 481/75, 76, 80, 82, 89, 93

(56) References Cited

U.S. PATENT DOCUMENTS 4,557,079 A * 12/1985 Sheesley ..... 451/76
4,819,388 A * 4/1989 Kirkalnd ..... 451/76
5,813,901 A * 9/1998 Kremen ..... 451/28

FOREIGN PATENT DOCUMENTS

JP 49-78995 7/1974
JP 07-227755 8/1995
JP 2001-138207 A 5/2001

* cited by examiner

*Primary Examiner*—Joseph J. Hail, III
*Assistant Examiner*—Shantese McDonald
(74) *Attorney, Agent, or Firm*—Frishauf, Holtz, Goodman & Chick, P.C.

(57) ABSTRACT

Disclosed are a method of causing abrasive grains to collide against and contact with an object being treated to form surfaces of the object being treated into a matte, specifically, a rotational magnetic field is applied on magnetic abrasive grains to cause the same to vibratingly move at random to collide against and contact with an object being treated to obtain a matte.

20 Claims, 6 Drawing Sheets

SURFACE ROUGHENING TREATMENT METHOD OF OBJECT BEING TREATED, AND APPARATUS THEREFOR

BACKGROUND OF THE INVENTION

The present invention relates to a method of causing abrasive grains to collide against and contact with an object being treated to form surfaces of the object into a matte. Specifically, a rotational magnetic field is applied on magnetic abrasive grains to cause the same to vibratingly move at random to collide against and contact with an object being treated to obtain a matte. More specifically, the invention is applied on finishing of an aluminum pipe for electrophotographic photosensitive body.

Conventionally, the dry shot blasting method and the wet shot blasting method have been used for matte treatment of an object being treated. These methods cause jet of a working fluid, for example, compressed air, or acceleration of a medium with the use of an impeller to cause the same to collide against an object being treated to finish surfaces of the object being treated. However, there is a need of supplying a medium, separating a medium made fine due to collision, replenishing a medium, or the like, which requires a large-scaled equipment. In order to solve such problem, a method has been disclosed, in which an object being treated is received in a vessel, which is filled with abrasive grains and possesses gas permeability, and compressed air from an air nozzle with a tip end thereof directed toward the object being treated is jetted toward the object being treated to perform surface treatment of the object being treated (Japanese Provisional Patent Publication No. 78995/1974). However, only effects of not much more than descaling, derusting can be expected of such methods.

Meanwhile, a method has been disclosed, in which a rotational magnetic field is applied (Japanese Provisional Patent Publication No. 227755/1995). With such method, a permanent magnet or a direct current electromagnet are mounted on a doughnut-shaped yoke to be rotated, and when the method is applied on magnetic abrasive grains charged in a surface treatment vessel, magnetic abrasive grains are put together in a chain manner to be taken along and rotated with rotation of magnetic poles while being attracted to surfaces of the surface treatment vessel (in many cases, serving also as an object being treated) by magnetic forces, thus rubbing surfaces of the object being treated, so that even if surfaces of the object being treated are polished and smoothed, effects of much more than that cannot be expected.

Further, methods making use of a rotational magnetic field includes a method, in which AC voltage is applied on a rotational magnetic field generating device formed in a motor/stator manner (Japanese Provisional Patent Publication No. 2001-138207). With such method, magnetic abrasive grains are not put together in a chain manner but is made independent one by one, and magnetic poles change in a very short time in one location, so that magnetic abrasive grains vibratingly move at random to collide against and contact with an object being treated to make surfaces of the object a matte. Therefore, the method appears at a glance to be valuable as a matte treatment method for surfaces of an object being treated, but it exceedingly detracts efficiency in terms of utilization of a rotational magnetic field and exceedingly degrades a commercial value because no account is taken of that blackening phenomenon of surfaces of an object being treated, caused due to the fact that fine powder of an object being treated is generated as the surface roughening treatment proceeds and the fine powder remains in the vessel as it is. Further stated, no account is taken to obtain uniformity of quality in the case of industrial application.

Also, when applied repeatedly to the electromagnetic type surface roughening method in an ordinary manner, magnetic abrasive grains are gradually increased in residual magnetic forces, which impede vibratory move at random to make it difficult to obtain a desired surface roughness.

Further, in the case where aluminum or aluminum alloy drawn tubes are used as a substrate for electrophotographic photosensitive body, there is a need of rough cutting and finishing cutting prior to application of the dry shot blasting method or the wet shot blasting method. Cost for finishing cutting accounts for a major part of cost for treatment, and so a demand for cost reduction is pressing.

SUMMARY OF THE INVENTION

The invention has been thought of in view of the above situation, and provides means capable of stably mass-producing an article, which is inexpensive and high in quality of goods and surfaces of which are roughened, in particular, a substrate for electrophotographic photosensitive body.

That is, the invention provides an apparatus for using magnetic abrasive grains to perform treatment roughening surfaces of an object being treated, comprising a rotational magnetic field generating device connected to a three-phase alternating current power source and formed in the form of a motor/stator, a surface roughening treatment vessel in the form of a hollow cylinder arranged substantially coaxially in the rotational magnetic field generating device and made of a non-magnetic conductive material, the surface roughening treatment vessel being capable of receiving the object in the form of a hollow cylinder being treated, in a lumen thereof and having a volume capable of receiving magnetic abrasive grains being a processing medium, the rotational magnetic field generating device being wound in a manner of a two-pole motor/stator, and an iron core inserted into a lumen of the object being treated, received in the surface roughening treatment vessel to be able to hold and rotate the object being treated, about an axis thereof.

Here, "substantially coaxially" does not require a strict coaxial relationship but comprehends arrangement of both associated elements somewhat offset to constitute no hindrance at the time of assembly and relative movements as far as an object being treated can be subjected to surface roughening treatment to involve a surface condition of a desired quality, which is an object of the invention, and means allowing a state, in which at least longitudinal axes of the both elements are parallel to each other and present on a vertical axis perpendicular to them.

Meanwhile, the invention provides a method of performing treatment roughening surfaces of an object being treated, comprising the steps of: applying a three-phase alternating voltage to a rotational magnetic field generating device formed in a two-pole motor/stator to generate a rotational magnetic field, causing magnetic abrasive grains introduced into a surface roughening treatment vessel, which is in the form of a hollow cylinder and arranged in a lumen of the rotational magnetic field generating device, to move at random, and rotating an iron core arranged in a lumen of the surface roughening treatment vessel and causing magnetic abrasive grains to collide against and contact with surfaces of an object being treated, held on an outer surface of the iron core.

DESCRIPTION OF THE PREFERRED EMBODIMENTS

An explanation will be given below in detail to an apparatus and a method according to the invention with reference to the drawings.

EXAMPLE 1

Figure 1:
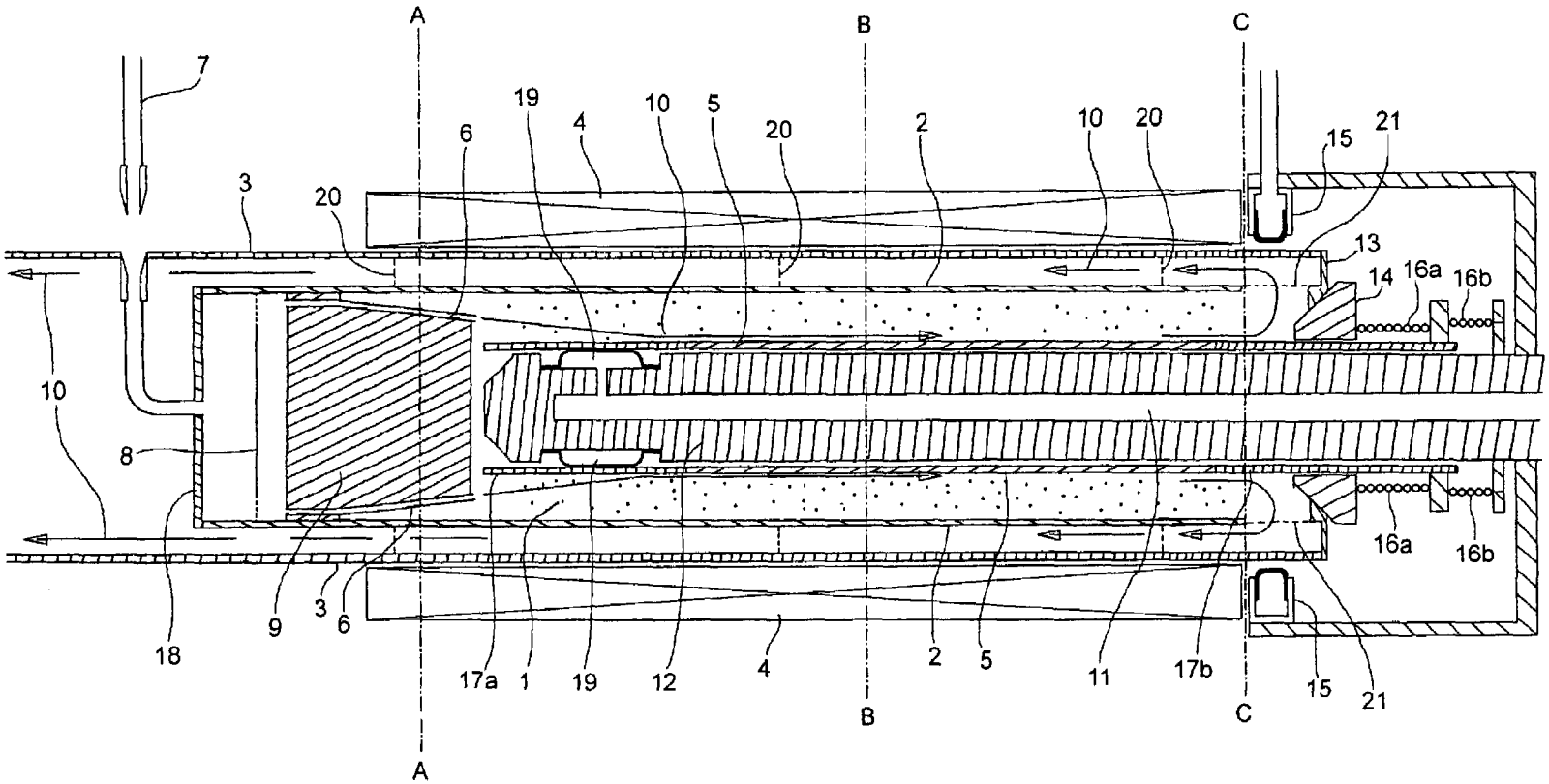
FIG. 1 is a cross sectional view showing a constitution of an embodiment of the invention.
Figure 2:
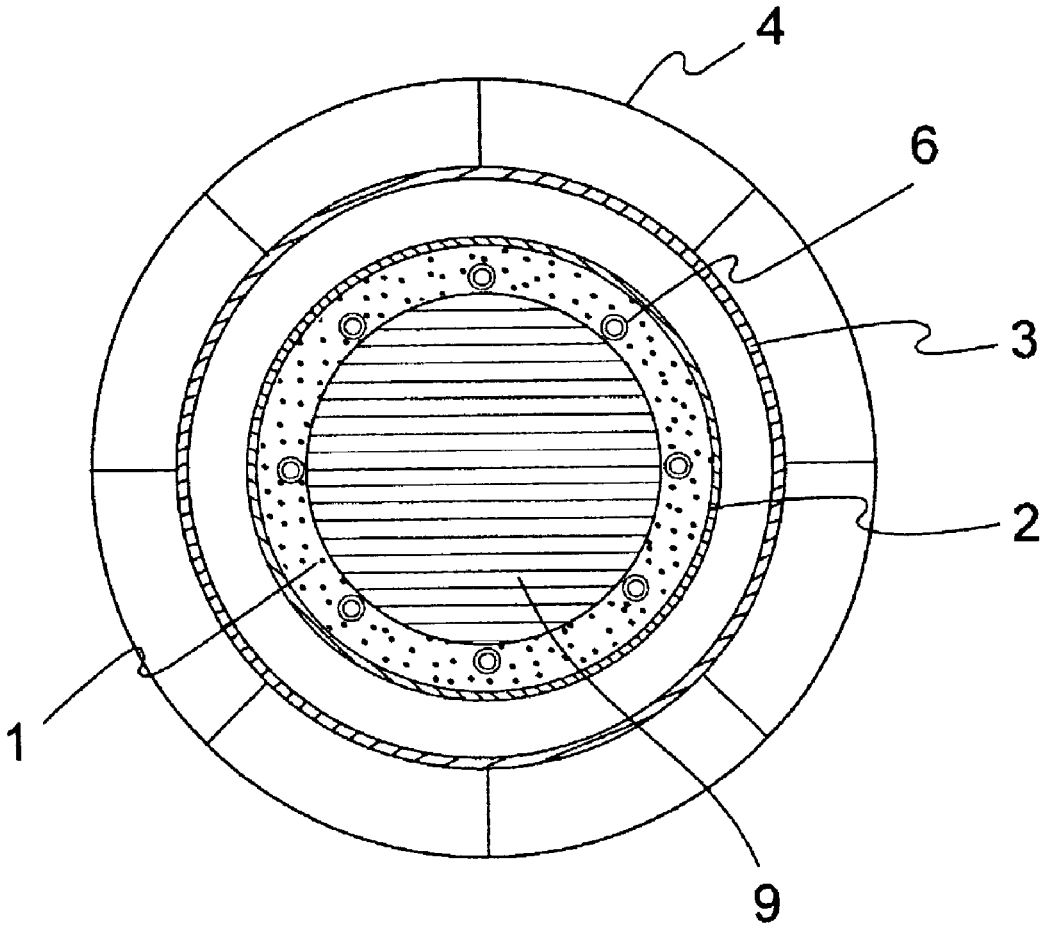
FIG. 2 is a cross sectional view taken along the line A—A in FIG. 1.
Figure 3:
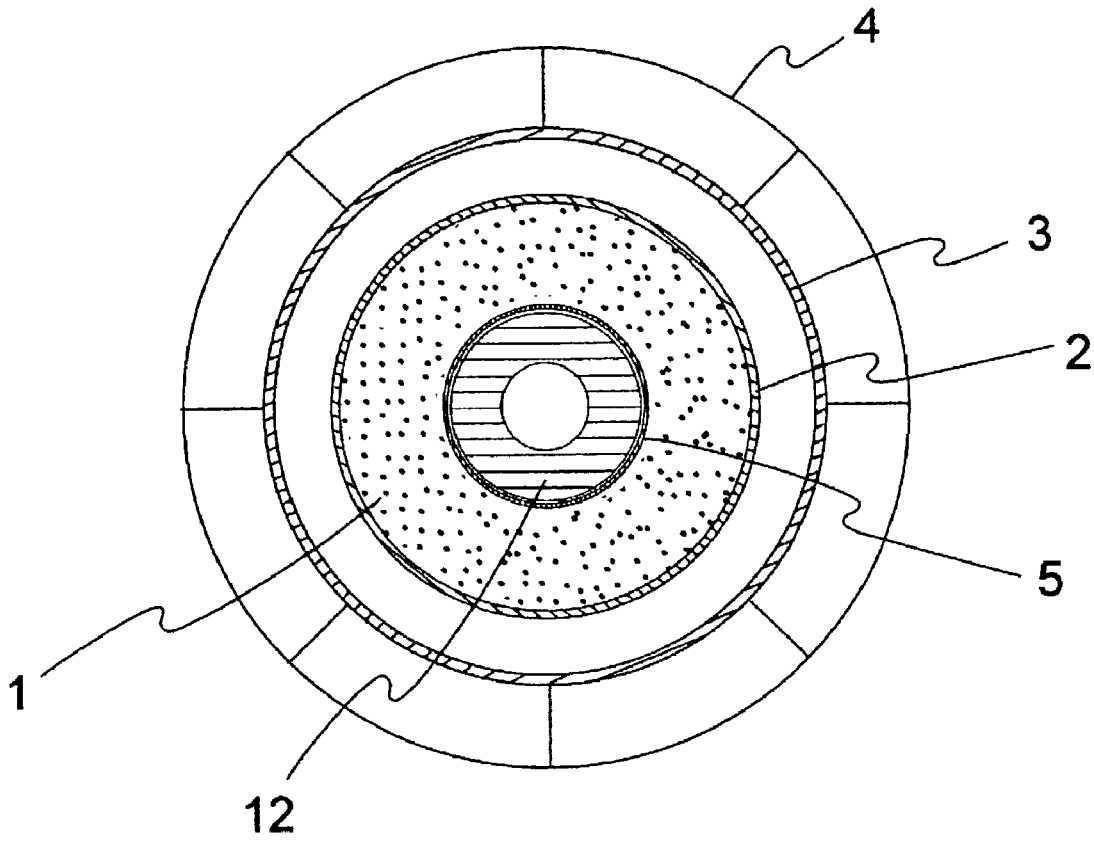
FIG. 3 is a cross sectional view taken along the line B—B in FIG. 1.
Figure 4:
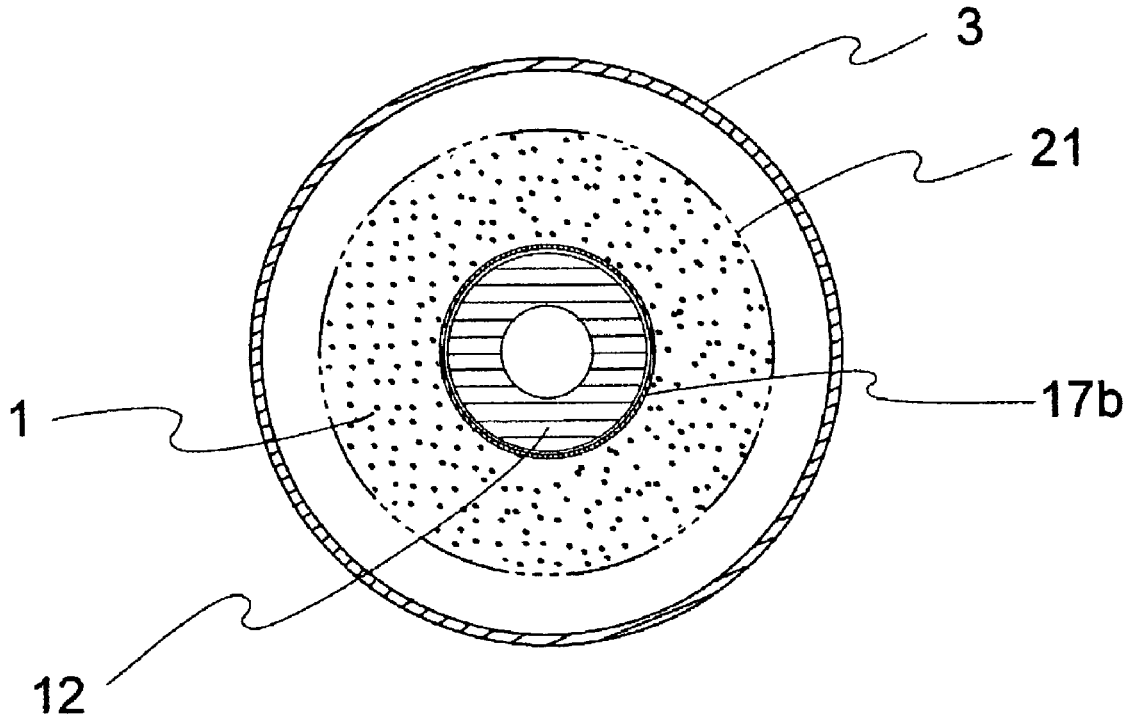
FIG. 4 is a cross sectional view taken along the line C—C in FIG. 1.

An apparatus shown in FIG. 1, that is, an apparatus having the following constituent members, was used. In addition, FIGS. 2 to 4 are a cross sectional view taken along the line A—A in FIG. 1, a cross sectional view taken along the line B—B, and a cross sectional view taken along the line C—C (for the sake of avoiding complexity in the figures, a rotational magnetic field generating device 4 described later is indicated by lines. Also, abrasive grains as a surface roughening medium are symbolically shown in the figures as well as FIG. 1). Here, in descriptions regarding directions in the specification as well as in claims, "right" indicates a sense toward the line C—C from the line A—A in FIG. 1 while "left" indicates a sense toward the line A—A from the line C—C in FIG. 1.

(1) Rotational Magnetic Field Generating Device 4:

The device is composed of two-pole stator (inner diameter: 83 mmΦ, length of coil winding: 475 mm) (the stator is electrically connected to a three-phase alternating current power source (not shown)). In addition, the use of the two-pole stator constitutes an important feature of the invention. A concrete effect of using the two-pole stator will become apparent from the following description.

(2) Surface Roughening Treatment Vessel 2:

The vessel is composed of a hollow cylinder (while being varied depending upon a size of an object 5 being treated, a cylinder having an outer diameter of 60 mmΦ, inner diameter of 59 mmΦ, and a length of 680 mm is used in this example) made of a non-magnetic conductive material (in this example, SUS316 is used), and is a member, an inner space of which received therein an object 5 being treated and an iron core 12 described later and which provides a place where the object 5 being treated is subjected to surface roughening treatment, confines therein abrasive grains as a surface roughening medium and compartments fields of air flow. Preferably, the vessel is arranged substantially coaxial with the rotational magnetic field generating device 4 (Such elements such as "nozzle fixing block 9", "wire gauze 8", "closure plate 18", "jacket 3", "iron core 12", "seal block 14" are arranged in the same manner. In addition, "surface roughening treatment vessel 2", "nozzle fixing block 9", "wire gauze 8", "closure plate 18", "jacket 3", "iron core 12", "seal block 14" are preferably arranged in a coaxial relationship).

(3) Nozzle Fixing Block 9:

The block is a member made of a non-magnetic conductive material (aluminum in this example) and having a base (left side) defined by a columnar portion, a side of which abuts against an inner surface of the surface roughening treatment vessel 2, and a frustum portion (diameter of a cone base: 50.0 mmΦ, diameter of a cone tip end: 37.5 mmΦ) on a right side of the base. A plurality of air stream generating nozzles 6 are provided in equal spacing on a side of the cone. While the number of and inner diameter of the air stream generating nozzles 6 are varied depending upon a size of the surface roughening treatment vessel 2, they are 8 in number and 1 mmΦ in this example. Also, an angle of the air stream generating nozzles 6 is 7° to 12° (8.9° in this example) relative to an axis of an object 5 being treated, and tip ends of the nozzles are positioned so that extension lines of axes of the air stream generating nozzles are 10 mm from a left end of a left spacer 17*a* described later toward a right end side. In short, it suffices that air streams be introduced to strike against a region extending to a right end from the left end of the left spacer (as a result, air streams as rectified and streamlined will flow at least in the vicinity of an object being treated, so that fine powder (referred below to as "fine powder resulted from an object being treated") of the object being treated is prevented from adhering to the object being treated, and since air streams in a space on walls of the surface roughening treatment vessel are small in rate of flow, movements of abrasive grains in a longitudinal direction are small and as a result ununiformity is hard to generate in concentration of abrasive grains in the longitudinal direction). In addition, through holes contiguous to the respective air stream generating nozzles 6 in an airtight manner are formed on a lower portion in the vicinity of a side of the columnar portion (in this example, small pipes of stainless steel are embedded). While the air stream generating nozzles 6 are used taking account of easiness in installation in this example, means corresponding to the nozzles, for example, through holes in parallel to a surface of the cone portion may be formed on a lower portion in the vicinity of a side of the cone portion (of course, the number of and a cross sectional area of the through holes must be equal to those of the air stream generating nozzles). In addition, it is necessary that an air being introduced contains no condensed water drops.

(4) Wire Gauze 8:

The wire gauze serves as means for performing rectification of air streams, and is a wire gauze (aperture: 74 $\mu$m) of SUS316, of which an outer peripheral surface abuts against the inner surface of the surface roughening treatment vessel 2 and a central portion (while being varied depending upon the size of the surface roughening treatment vessel 2, it extends 45 mmΦ from a center thereof in this example) is blanked. The wire gauze is anchored in a position leftwardly of a left end of the base of the nozzle fixing block 9 and 10 mm from a left end of the surface roughening treatment vessel 2. This position is suitably changed depending upon the size of the surface roughening treatment vessel 2.

(5) Closure Plate 18:

The plate is a member (made of aluminum in this example) installed at the left end of the surface roughening treatment vessel 2 to close the surface roughening treatment vessel. Connected to a center of the plate is a compressed air introduction pipe 7 (a material of which is not limited, and an urethane tube was used in this example. While the tube is changed in diameter depending upon the size of the surface roughening treatment vessel 2, a tube having an inner diameter of 4 mmΦ and an outer diameter of 6 mmΦ was used in this example.) for introduction of air streams. In addition, the other end of the tube is connected to a compressed air source (not shown) via a through means of the jacket 3 described later, a connection means with an external tube (when the jacket can be taken out from the rotational magnetic field generating device 4, the means is not specifically limitative, and an auto coupler was used in this example. A female portion of the coupler is fixed to a wall surface of the jacket to extend therethrough, and a male portion of the coupler is fixed to an end of the external tube to be able to be detachably engaged by the female portion of the coupler.), and flow control means.

(6) Jacket 3:

The jacket is a hollow member (made of SUS316) to receive therein the surface roughening treatment vessel 2, an inner surface of the member and an outer surface of the surface roughening treatment vessel defining an air stream return passage (Communication to the air stream return passage from the surface roughening treatment vessel is given through openings 21 provided on a right end of the surface roughening treatment vessel. Here, the openings may comprise a plurality of slits (portions indicated by a broken line) formed at regular intervals about an axis on a peripheral surface in the vicinity of a right end of the surface roughening treatment vessel as shown in FIG. 4, and by providing a gap between the right end of the surface roughening treatment vessel and the right end of the jacket and connecting the ends of the both by means of a plurality of spacers provided at regular intervals about an axis, a space except those portions which the spacers occupy may be allotted to the openings. An area of the openings suffices to be one not to impede smooth flowing of air streams, and preferably an opening ratio, that is, an area of the openings/an entire area of portions having the openings is 50 to 90%, in particular, preferably 70 to 80%. In addition, it is necessary that wire gauze is provided on the openings to prevent abrasive grains from rushing out.). While the jacket changed in size depending upon the size of the surface roughening treatment vessel, a pipe having an outer diameter of 81 mmΦ, inner diameter of 80 mmΦ, and a length of 750 mm was used in this example. In addition, for the purpose of alignment with the surface roughening treatment vessel, three doughnut-shaped wire gauzees 20 made of SUS316 (aperture: 150 $\mu$m, outer diameter: 80 mmΦ, inner diameter: 61 mmΦ, these dimensions being changed depending upon the size of the surface roughening treatment vessel) were fitted onto an outer side of the surface roughening treatment vessel, and then the member was covered on them (A position of fitting is 50 mm from the left end of the surface roughening treatment vessel, 50 mm from the right end thereof, and centrally in an axial direction of the surface roughening treatment vessel). Also, fixed to a right end of the member is a doughnut-shaped seal member 13 (while a material thereof is not limitative provided that an edge of a central hole thereof abuts against an outer peripheral surface of a seal block 14 described later to be able to substantially shut off communication of an air inside and outside the jacket and rushing-out of abrasive grains, an aluminum plate having a thickness of 10 mm is used in this example, and a member (of which a central hole correctly corresponds to the central hole of the seal member 13) is mounted on the edge of the central hole, the member abutting against the outer peripheral surface of the seal block 14 in a male/female relationship (while the seal member is female and the seal block 14 is male in the figure, the male/female relationship may be reversed as far as the function of sealing is achieved). In addition, the member may be formed integral with a body of the seal member, or may be manufactured separately from the body of the seal member and assembled by means of suitable engagement means, for example, screw thread engagement means, which is composed of an external thread (formed on an outer side of the member) and an internal thread (formed on an inner peripheral surface of the body of the seal member), or may be of a fitting construction) having centrally at a right end thereof a hole capable of insertably receiving an object 5 being treated, and an exhaust filter (not shown) for removing fine powder resulted from an object being treated entrained in air streams in the surface roughening treatment is connected to a left end of the jacket through suitable means, for example, duct or the like.

(7) Iron Core 12:

The core is a magnetic resistance reducing member (being also magnetic force reinforcing means induced to abrasive grains, which make a medium for the surface roughening treatment) (made of soft iron, and having a size of 27.5 mmΦ×520 mmL) arranged in a lumen of an object 5 being treated. Preferably, a clearance (generally, 0.05 mm to 0.5 mm) between an inner surface of the object being treated and an outer surface of the member is made as small as possible as long as the object being treated is not injured when the object being treated is removed from and mounted on the member. In this example, the size was 0.25 mm. Here, the reference numeral 11 denotes a passage of a working medium (generally, compressed air) of a holding member 19 described later (while a diameter of the passage is determined taking account of an effect taken by reduction of magnetic resistance and pressure drop at the time of supplying of a working medium, it is preferably as small as possible since the object of the invention is directed to surface roughening of an object being treated. Incidentally, the diameter was 10 mmΦ). In addition, a right end of the iron core is connected to a means for affording axial movements thereof, for example, a rodless air cylinder or the like. Concretely, the iron core kept horizontal is rotatably mounted on a fixing plate (not shown) through a suitable bearing means, for example, mechanical bearing, oilless bearing, or the like, the fixing plate is further fixed to a base (not shown), which mounts thereto the plate, and the base is fixed to a sleeve (not shown) of a linear guide and moved axially of the iron core by means of the rodless air cylinder.

(8) Holding Member 19:

The member is a member for holding an object 5 being treated, integrally on the iron core 12 while maintaining a clearance (clearance between an inner surface of the object 5 being treated and the iron core 12) between the both. Provided that the above object can be attained, the member is not limitative, and an air picker (a bag having the elasticity affording expansion of the bag when a working medium is received in a lumen thereof, the bag extending over an entire periphery of a peripheral surface of a particular width of the iron core 12) was used in this example. The member was arranged in the vicinity of a left end of the iron core 12 in order to prevent abrasive grains from entering into a clearance between the object 5 being treated and the iron core. In addition, since the member is arranged to thereby reduce a diameter of the iron core 12, magnetism induced to abrasive grains 1 from the rotational magnetic field generating device 4 in this region is varied to impair uniformity of surface roughening treatment, and therefore an object being treated, corresponding to such region is replaced by a spacer 17*a* described later (Accordingly, what is directly held by the member is the spacer 17*a* arranged leftwardly of the object 5 being treated, in a state, in which end surfaces thereof butt at each other).

(9) Grip Member 15:

The member is a member for gripping a right portion of the jacket 3 to assure axial movements thereof. As far as the above object can be attained, the member is not limitative, and an air gripper (a bag having the elasticity affording expansion of the bag toward an axis when a working medium is received in a lumen thereof, the bag coming into close contact with an entire periphery of a peripheral surface of a particular width of the jacket) was used in this example. In addition, the grip member 15 is fixed to the iron core 12 through a suitable structural member such as frame, or the like.

(10) Seal Block 14:

The block is a member (a material of which is not specifically limitative provided that the material is a non-magnetic conductive material, and the material is a conductive polyacetal in this example) for preventing leakage of abrasive grains 1 in the surface roughening treatment of an object 5 being treated, fine powder resulted from the object being treated, generated in the course of surface roughening treatment, compressed air, which are supplied to a lumen of the surface roughening treatment vessel 2, the member being a frustum having a side adapted to come into surface contact with a central hole of the seal member 13 (Correctly, a central hole of a frustum-shaped member anchored to an edge of the central hole of the seal member) in a male/female relationship (While the seal block 14 is male in the figure, the member on the seal member may be male and the seal block may be female), and the member being a doughnut-shaped member having an inner diameter, which provides a clearance not to impair rotation of the object 5 being treated (Correctly, a spacer 17*b* arranged rightwardly of the object 5 being treated, in a state, in which end surfaces thereof butt at each other, in order to ensure uniformity of the object 5 being treated.) (When the object being treated is rotated, an edge of a hole of the seal block and an outer surface of the spacer slide relative to each other. In addition, outside leakage of compressed air containing fine powder resulted from the object being treated, through the clearance is substantially prevented by applying grease or the like on the edge of the hole of the seal block). As shown in the drawings, the member is biased leftward by a compression spring 16*a,* an end of which is fixed to a block fixed to a right end of the spacer, a tapered side of the seal block abuts airtightly against the edge of the central hole of the seal member 13. Further, the block is biased leftward by a compression spring 16*b,* an end of which is fixed to a block fixed to the iron core 12. Accordingly, the object 5 being treated, of which end surfaces butt against the spacer 17*a* (an inner peripheral surface near a left end of which is held integrally on the iron core 12 by the holding member 19) arranged leftwardly thereof and the spacer 17*b* arranged rightwardly thereof, is made by spring forces of the compression spring 16*b* to be able to behave as if it were a single cylinder.

In addition, while materials used in this example have been clearly described with respect to the respective constituent members, it is natural that the members except the iron core 12, the rotational magnetic field generating device 4 and abrasive grains are not limited to the materials clearly described provided that materials used are made of a non-magnetic conductive material and have properties, such as physical strength, required for the respective members.

Subsequently, concrete operations in the surface roughening treatment will be described.

A. 180 g of abrasive grains (formed by cutting a wire made of SUS304 for spring to a predetermined length) having a size of 0.2 mmΦ×3 mmL was charged into the surface roughening treatment vessel 2 mounted in the lumen of the jacket 3 in a substantially coaxial manner.

Figure 5:
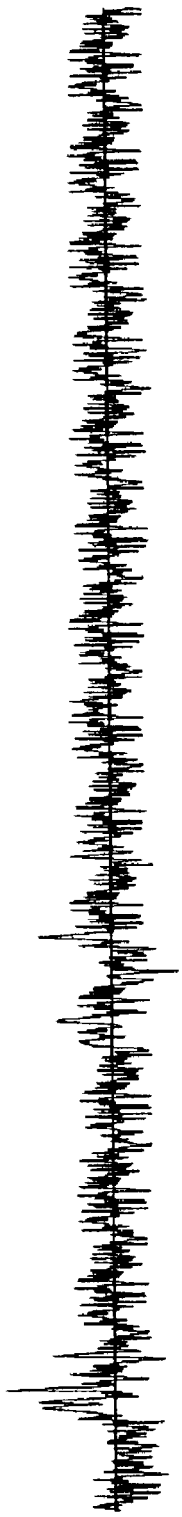
FIG. 5 is a view showing a surface condition of an object being treated, used in examples and comparative examples prior to treatment and represented in terms of surface roughness.

B. A spacer 17*b* having an outer diameter of 30 mmΦ (inner diameter of 28.5 mmΦ)×130 mmL, an object 5 being treated, having an outer diameter of 30 mmΦ (inner diameter of 28.5 mmΦ)×248 mmL, a spacer 17*a* having an outer diameter of 30 mmΦ (inner diameter of 28.5 mmΦ)×130 mmL, were pushed onto an outer surface of the iron core 12 in this order, and an air picker 19 was used to feed a compressed air to grip the spacer 17*a*. Here, since the spacer 17*b* is biased leftward by the compression spring 16*b*, the spacer 17*a*, the object 5 being treated, and the spacer 17*b* behave as if they are a single cylinder (referred below to as "work"), and they are put in a state, in which they are made integral with the iron core 12. Also, a rough cutting aluminum pipe being a material of a substrate for electrophotographic photosensitive body was used for the object 5 being treated. Rough cutting was carried out by the use of a compax bite having a nose radius of 50 mm under the condition of speed of rotation: 6000 rpm, feed: 0.4 mm/rpm, and machining allowance: 0.1 mm. FIG. 5 shows surface roughness (surface roughness prescribed in JIS B 0601. The following descriptions are the same with respect to surface roughness) of the rough cutting pipe (Here, Surfcorder SE-3400 manufactured by Kosaka Gijutsu Kenkyusho was used for measurement of surface roughness. Conditions of measurement were filter: Gaussian, cut-off: 0.8 mm, length of estimation: 4 mm, and stylus feed: 0.5 mm/sec, and conditions of roughness curve were longitudinal magnification of display: 10,000, lateral magnification of display: 50, longitudinal graduation: 1 μm/10 mm, and lateral graduation: 200 μm/10 mm. The following descriptions are the same with respect to surface roughness). In addition, a material for the spacers 17*a*, 17*b* was the same as that of the object being treated, for the convenience of handling. Of course, it goes without saying that the spacers are not limited to the above provided that a material therefor is a non-magnetic conductive material having that physical strength, which can stably hold the object 5 being treated, on the iron core, and that wear resistance, which can stand collision of abrasive grains.

C. A rodless air cylinder (not shown) was operated to mount that iron core 12, which mounted thereto a work engaged by the cylinder through a fixing plate mount base and a fixing plate (not shown), in the lumen of the surface roughening treatment vessel 2. Here, since the tapered side of the seal block 14 biased leftward by the compression spring 16*a* abutted against the edge of the central hole of the seal member 13, the object 5 being treated was charged into the lumen of the surface roughening treatment vessel in an airtight state (surface roughening treatment standby state).

D. The iron core 12 was rotated (20 rpm) by rotation means (not shown), and a pressure regulating valve (not shown) was operated to adjust the pressure of compressed air to 0.08 MPa, which compressed air was introduced into the lumen of the surface roughening treatment vessel 2 through the tube 7, wire gauze 8 and the air stream generating nozzles 6 of the nozzle fixing block 9 (blowoff wind velocity of the nozzles: 300 m/sec). Here, arrows shown in FIG. 1 indicate directions of air streams.

E. A three-phase alternating current power source applied voltage (14V) to the two-pole stator of the rotational magnetic field generating device 4 (current value: 18A) to carry out the surface roughening treatment. Here, since the object 5 being treated was made integral with the iron core 12, it was rotated at 20 rpm.

F. The applied voltage was shut off, introduction of compressed air was stopped, rotation of the iron core 12 was stopped, the iron core 12 was taken out from the surface roughening treatment vessel 2, and then the air picker 19 was made off (feed of compressed air to the air picker was stopped to deflate the air picker). In this state, the object 5 being treated was taken out from the iron core 12, and a surface condition of the object was visually observed. Fine powder resulted from the object being treated was small in amount, and the surface of the object being treated was white. Also, no difference in dent density in a longitudinal direction was found on the object 5 being treated (The density corresponds to (d) in FIG. 6 over the entire length).

Figure 6:
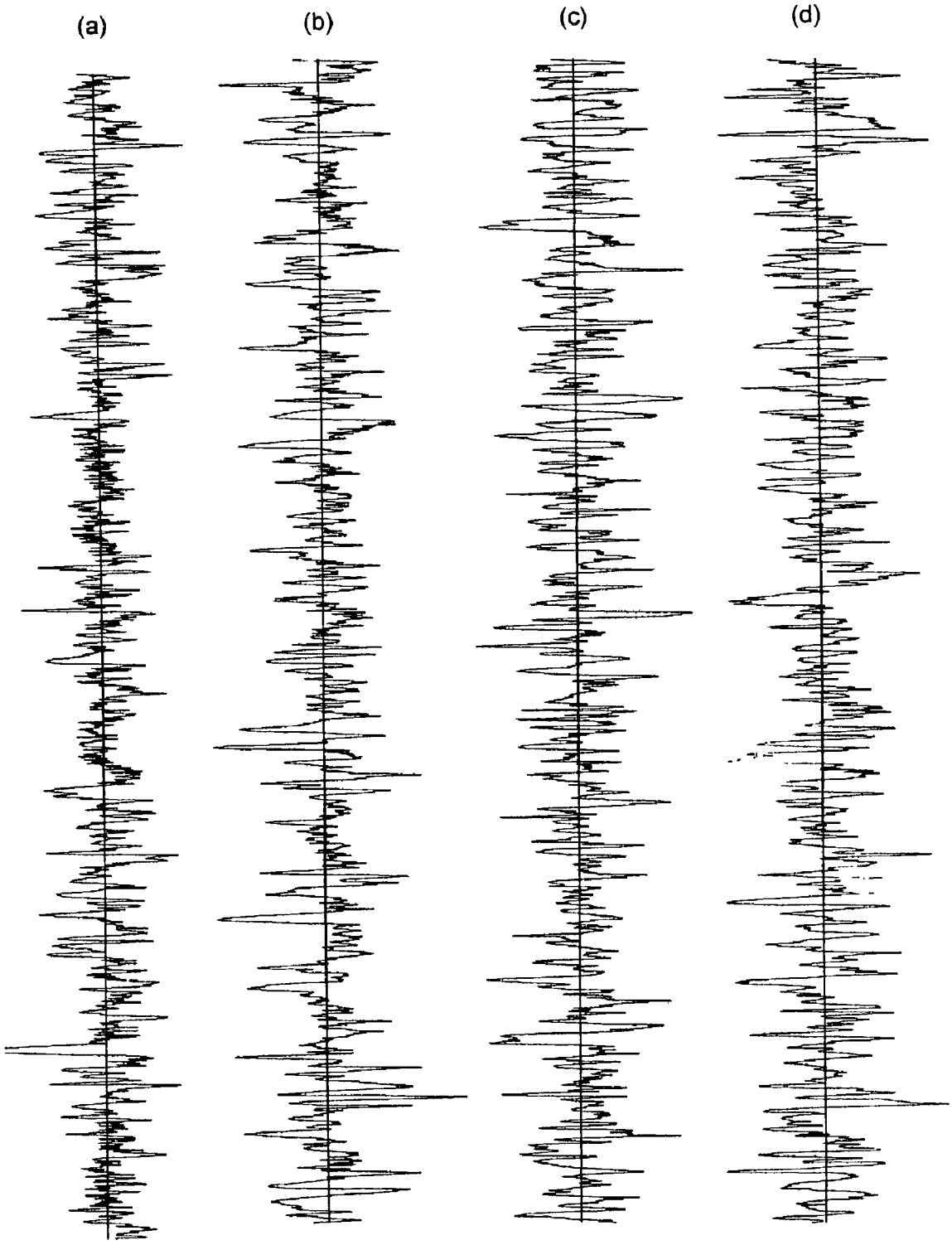
FIG. 6 is a view showing a surface condition of an object being treated, used in an example 1 after to treatment and represented in terms of surface roughness.

In addition, charts shown in FIG. 6 represent states of dents on objects being treated, after surface roughening treatment under the above conditions except an amount of abrasive grains, in a surface configuration by surface roughness measurement. Here, (a) involves an amount of abrasive grains being 45 g, (b) 90 g, (c) 150 g, and (d) 180 g. In the case of an amount of abrasive grains being at least 150 g, small irregularities (streaks caused by feed of a turning tool) formed by a bite on surfaces of rough cutting pipes prior to the treatment and having a small width disappeared to a predetermined state, and so those objects being treated, in which a state of surface roughness corresponding to those with an amount of abrasive grains being 150 g or 180 g is obtained, are made "acceptable dent density" in the following examples.

G. Whenever the surface roughening treatment was performed ten times, after the treatment at that occasion was terminated, the air gripper 15 was made ON (Compressed air was fed to the air gripper to cause the same to grip an outer surface of the jacket 3), the auto coupler 7 was made OFF (Engagement of male and female portions thereof was released), and a rodless air cylinder (not shown) was used to take out the jacket 3 and the surface roughening treatment vessel 2, on which a work and the iron core 12 were mounted, from the rotational magnetic field generating device 4. At this time, introduction of compressed air and rotation of the iron core 12 were stopped, while electric power was continuously fed to the stator of the rotational magnetic field generating device. After the above taking-out (10 seconds) was terminated, feed of electric power to the stator of the rotational magnetic field generating device was stopped, and the whole parts once taken out were again inserted into the lumen of the rotational magnetic field generating device as they were. Subsequently, the air gripper 15 was made OFF, and only the work and the iron core 12 were taken out from the rotational magnetic field generating device 4. And in a state (A cover or the like plugged the central hole of the seal member 13), in which the work and the iron core 12 were not present, electric power was fed to the stator of the rotational magnetic field generating device during 10 seconds. These correspond to "demagnetizing operation" and "abrasive grain uniformizing operation in an axial direction". In addition, when "demagnetizing operation" was not performed, N and S poles of abrasive grains magnetized attracted each other to make the whole abrasive grains a lump, while abrasive grains after "demagnetizing operation" were not made a lump but loose. Also, the distribution of abrasive grains after "abrasive grain uniformizing operation in an axial direction" was substantially uniform in the axial direction. The surface roughening treatment was performed fifty times with a single "demagnetizing operation" intervened every ten times, and no change was found in a surface condition (color and dent density) of the objects 5 being treated, at the first time and the fiftieth time.

EXAMPLE 2

Surface roughening treatment on objects 5 being treated (the number of objects being 20) was performed in the same apparatus and operating condition as those in the example 1 except that no introduction of compressed air into a surface roughening treatment vessel 2 was made and that "demagnetizing operation" and "abrasive grain uniformizing operation in an axial direction" were not performed. Like the example 1, a first object being treated involved less adherence of fine powder resulted from the object being treated, and had white surfaces. Also, no difference in dent density in a longitudinal direction was found on the object 5 being treated (a state shown in FIG. 6(*d*)). However, it was recognized that a second object being treated involved somewhat adherence of fine powder resulted from the object being treated, surfaces of a third object being treated began to become black, the more the number of objects being treated, the more adherence of fine powder resulted from an object being treated, and surfaces of a seventh object being treated became completely black (the dent density being acceptable). Further, a fifteenth object being treated began to be decreased in dent density over the entire surfaces thereof (a state shown in FIG. 6(*b*), that is, a state, in which streaks of a turning tool remained partially). Hereupon, prior to the surface roughening treatment of a sixteenth object being treated, the procedure was modified into a pattern, in which "demagnetizing operation" and "abrasive grain uniformizing operation in an axial direction" were performed, shown in the example 1, and then reduction in dent density of the fifteenth object being treated was not observed. It has been found from results of this example that products meeting a predetermined level in terms of dent density can be obtained by performing "demagnetizing operation" and "abrasive grain uniformizing operation in an axial direction" before dent density begins to decrease, and so such products are usable for applications, in which blacking is not problematic.

Incidentally, blacking of surfaces is attributable to adherence of fine powder resulted from an object being treated, and such powder adhered cannot be removed with air blow or the like, but can be finally removed by means of a chemical processing, for example, cleaning with a solution of sodium hydroxide.

EXAMPLE 3

Surface roughening treatment on objects 5 being treated (the number of objects being 20) was performed in the same apparatus and operating condition as those in the example 2 except that after surface roughening treatment of one object 5 being treated was terminated, only a work and the iron core 12 were taken out from the rotational magnetic field generating device 4, and after a cover or the like (whatever will do provided that the central hole of the seal member 13 was plugged) plugged, introduction of compressed air and application of voltage were simultaneously performed for 30 seconds, introduction of compressed air was stopped and only application of voltage was performed for 5 seconds, and then a new work was charged. Like a first object being treated, second and succeeding objects being treated involved less adherence of fine powder resulted from the objects being treated, and the objects 5 being treated kept white surfaces. Of course, no difference in dent density in a longitudinal direction was found on the objects 5 being treated (the dent density being acceptable). However, a fifteenth object being treated began to be decreased in dent density over the entire surfaces thereof (a state shown in FIG. 6(*b*)). In this example, it has been confirmed that degradation in dent density is made avoidable by modifying the procedure into a pattern, in which "demagnetizing operation" and "abrasive grain uniformizing operation in an axial direction" are performed prior to degradation in dent density, as described in the example 2.

EXAMPLE 4

Surface roughening treatment on objects 5 being treated (the number of objects being 10) was performed in the same apparatus and operating condition as those in the example 1 except a pattern (a pattern in the surface roughening treatment of one object being treated), in which introduction of compressed air into the surface roughening treatment vessel 2 was made ON for 25 seconds, Off for 5 seconds three times, and thereafter ON for 30 seconds (Concretely, the pattern was effected in combination with an ON/Off valve electrically connected to a timer and provided in an introduction path for compressed air, while the timer may be replaced by a sequencer or the like). Like the example 1, a tenth object being treated was susceptible of no blacking of surfaces attributable to adherence of fine powder resulted from the object being treated, and no change was found in dent density in a longitudinal direction (a state shown in FIG. 6(*d*)).

EXAMPLE 5

Surface roughening treatment on objects 5 being treated (the number of objects being 15) was performed in the same apparatus and operating condition as those in the example 1 except that no jacket (3) was used and introduction of compressed air into the surface roughening treatment vessel 2 was made at many points in a direction perpendicular to an axis of the surface roughening treatment vessel and the air was discharged at many points in a direction turned 180° relative to the direction of introduction (Concretely, an air was introduced into a first tubular body arranged on an outer peripheral surface of the surface roughening treatment vessel through a plurality of air introduction pipes arranged perpendicular to a longitudinal axis of the surface roughening treatment vessel and orthogonal to the tubular body, and extending through a wall of the surface roughening treatment vessel, and the introduced air was discharged into a second tubular body arranged on the outer peripheral surface of the surface roughening treatment vessel in a position symmetrical about the axis of the surface roughening treatment vessel relative to a position, in which the first tubular body was arranged, through a plurality of air discharge pipes extending through the wall of the surface roughening treatment vessel coaxially with axes of the air introduction pipes). Like the example 1, a first object being treated involved less adherence of fine powder resulted from the object being treated, and had white surfaces. Also, no difference in dent density in a longitudinal direction was found on the object 5 being treated (a state shown in FIG. 6(*d*)). However, surfaces of a second object being treated became completely black. Meanwhile, the dent density was acceptable in a state shown in FIG. 6(*c*), and such state was continued to fourteenth objects being treated. In this example, it has been also confirmed that degradation in dent density is made avoidbale by modifying the procedure into a pattern, in which "demagnetizing operation" and "abrasive grain uniformizing operation in an axial direction" are performed prior to degradation (immediately after the treatment of the fourteenth object being treated) in dent density, as described in the example 2.

EXAMPLE 6

Surface roughening treatment was performed in the same apparatus and operating condition as those in the example 1 except that the wire gauze 8 and the nozzle fixing block 9 were not used and a pattern of introduction of compressed air was made that in the example 4. A first object being treated caused a difference in dent density in a longitudinal direction of the object 5 being treated (an upstream side of air streams: a state shown in FIG. 6(*c*), a downstream side of air streams: a state shown in FIG. 6(*d*)), but it was on an acceptable level of dent density and was susceptible of no blacking. So, when a second object being treated was subjected to surface roughening treatment, blacking occurred and the dent density on an upstream side of air streams was made in a state shown in FIG. 6(*b*), so the succeeding surface roughening treatment was discontinued. Hereupon, it has been also confirmed in this example that degradation in dent density is made avoidable like the preceding examples by modifying the procedure into a pattern, in which "demagnetizing operation" and "abrasive grain uniformizing operation in an axial direction" (However, it is necessary to perform "abrasive grain uniformizing operation in an axial direction" each time an object being treated is treated and to perform "demagnetizing operation" each time fourteen objects being treated are treated) are performed prior to degradation in dent density, as described in the example 2.

EXAMPLE 7

In place of performing "demagnetizing operation" and "abrasive grain uniformizing operation in an axial direction" after treatment of a predetermined number of objects being treated, in the example 6, application of voltage (14V) and introduction of air (0.08 MPa) were made and then introduction of air was stopped and only the operation of application of voltage was made, each time treatment of one object being treated was terminated (the number of objects being treated: 15). With a first object being treated, the dent density in a longitudinal direction was in a state shown in FIG. 6(*c*) on an upstream side of air streams, and in a state shown in FIG. 6(*d*) on a downstream side of air streams, such situation being not varied up to a fourteenth object being treated. However, a fifteenth object being treated was generally in a state shown in FIG. 6(*b*). Meanwhile, there was involved less adherence of fine powder resulted from the object being treated, and the first to fifteenth objects being treated had white surfaces.

Comparative Example 1

Surface roughening treatment was performed in the same apparatus and operating condition as those in the example 1 except that poles of the stator of the rotational magnetic field generating device 4 was four in number and voltage applied on the stator of the rotational magnetic field generating device 4 was adjusted to provide a current value of 31 A (applied voltage: 22 V). Treatment time of ten minutes (the number of samples: 5) was necessary in order to obtain substantially the same dent density (in a state shown in FIG. 6(*d*), at least a state shown in FIG. 6(*c*)) as that of the object 5 being treated, in the first embodiment. Incidentally, treatment time of five minutes resulted in a state shown in FIG. 6(*b*).

Comparative Example 2

Surface roughening treatment was performed in the same apparatus and operating condition as those in the example 1 except that in place of the iron core 12, a core member made of a non-magnetic material and having the same shape as that of the iron core was used, and voltage applied on the stator of the rotational magnetic field generating device 4 was adjusted to provide a current value of 31 A (applied voltage: 25 V). Treatment time of six minutes (the number of samples: 5) was necessary in order to obtain substantially the same dent density (in a state shown in FIG. 6(*d*), at least a state shown in FIG. 6(*c*)) as that of the object 5 being treated, in the example 1.

Incidentally, treatment time of four minutes resulted in a state shown in FIG. 6(*b*).

Comparative Example 3

Surface roughening treatment was performed in the same apparatus and operating condition as those in the example 1 except that the wire gauze 8 and the nozzle fixing block 9 were not used. With a first object being treated, a difference in dent density in a longitudinal direction of the object 5 being treated was caused (an upstream side of air streams: a state shown in FIG. 6(*b*), a downstream side of air streams: a state shown in FIG. 6(*d*)), and so the succeeding surface roughening treatment was discontinued although the object was susceptible of no blacking on surfaces thereof.

While the embodiments have been described, in which rough cutting pipes as a material of a substrate for electrophotographic photosensitive body are used as an object being treated, test results have proved that the apparatus and method according to the invention are applicable to surface roughening treatment of an object being treated, which is a material enhanced in accuracy by non-cutting, such as extruded/drawn pipe (ED pipe), centerless ground pipe, or the like. Also, while it has been described that products resulted from the treatment are used for a substrate for electrophotographic photosensitive body, it is conceived from test results that the apparatus and method according to the invention are favorably applicable to a system on a level of 2400 dpi for a substrate for electrophotographic photosensitive body as well as a system on a level of 1200 dpi, and are further applicable to surface treatment of materials for developing rollers and fixing rollers. Besides, it is conceived that the thought of the apparatus and method according to the invention is applicable to not only a configuration described above, in which one object being treated is arranged in a single surface roughening treatment vessel, but also a configuration, in which plural objects being treated are arranged in a single surface roughening treatment vessel, for example, plural objects being treated are simultaneously subjected to surface roughening treatment by the use of a planetary gear for synchronous rotation.

As described above, with the apparatus and method according to the invention, it is possible to provide a product, of which surface is roughened and which is inexpensive and high in quality, for example, a product usable as a means for controlling the reflectance of a substrate for electrophotographic photosensitive body, and further a means capable of mass-producing substrates for electrophotographic photosensitive body (one of applications, for which dent density of at least a predetermined level and maintenance of white surface are demanded) stably at low cost.

What is claimed is:

1. An apparatus for using magnetic abrasive grains to perform treatment roughening surfaces of an object being treated, comprising a rotational magnetic field generating device connected to a three-phase alternating current power source and formed in the form of a motor/stator, a surface roughening treatment vessel in the form of a hollow cylinder arranged substantially coaxially in the rotational magnetic field generating device and made of a non-magnetic conductive material, the surface roughening treatment vessel being capable of receiving the object in the form of a hollow cylinder being treated, in a lumen thereof and having a volume capable of receiving magnetic abrasive grains being a processing medium, the rotational magnetic field generating device being wound in a manner of a two-pole motor/stator, and an iron core inserted into a lumen of the object being treated, received in the surface roughening treatment vessel to be able to hold and rotate the object being treated, about an axis thereof.

2. The apparatus according to claim 1, further comprising air introduction means for allowing air, which is introduced from one end of the surface roughening treatment vessel to be substantially rectified toward the other end of the apparatus, to flow into a space defined by an inner peripheral surface of the surface roughening treatment vessel and an outer peripheral surface of the object being treated.

3. The apparatus according to claim 2, wherein the air introduction means comprises a wire gauze arranged with a peripheral surface thereof abutting against an inner surface of the surface roughening treatment vessel, to rectify air streams introduced, and a member arranged rightwardly of the wire gauze with a peripheral surface thereof abutting against the inner surface of the surface roughening treatment vessel, the member allowing an air not to flow at a central portion thereof and having a plurality of blowoff holes on an edge of an outer periphery thereof, the blowoff holes having axes thereof inclined at 7 to 12° so as to bring into focus on a point on an axis of the surface roughening treatment vessel, respectively.

4. The apparatus according to claim 3, further comprising a doughnut-shaped member having a hole capable of receiving the object being treated to permit the same to be inserted centrally of a right end of the surface roughening treatment vessel, and a cone-shaped ring having a side capable of contacting with an edge of the central hole of the doughnut-shaped member, the ring being biased leftward by a compression spring, one end of which is anchored at a block fixed to a right end of a rightward spacer, to abut against the edge of the central hole of the doughnut-shaped member, and forming a seal for magnetic abrasive grains present in the surface roughening treatment vessel at the time of surface roughening treatment, fine powder resulted from the object being treated, at the time of surface roughening treatment, an air which are introduced into a space defined by an inner peripheral surface of the surface roughening treatment vessel and an outer peripheral surface of the object being treated, received in the lumen of the vessel and/or magnetic abrasive grains.

5. The apparatus according to claim 2, further comprising a doughnut-shaped member having a hole capable of receiving the object being treated to permit the same to be inserted centrally of a right end of the surface roughening treatment vessel, and a cone-shaped ring having a side capable of contacting with an edge of the central hole of the doughnut-shaped member, the ring being biased leftward by a compression spring, one end of which is anchored at a block fixed to a right end of a rightward spacer, to abut against the edge of the central hole of the doughnut-shaped member, and forming a seal for magnetic abrasive grains present in the surface roughening treatment vessel at the time of surface roughening treatment, fine powder resulted from the object being treated, at the time of surface roughening treatment, an air which are introduced into a space defined by an inner peripheral surface of the surface roughening treatment vessel and an outer peripheral surface of the object being treated, received in the lumen of the vessel and/or magnetic abrasive grains.

6. The apparatus according to claim 1, further comprising air introduction/discharge means for allowing air to be introduced at many points in a direction perpendicular to a longitudinal direction of the surface roughening treatment vessel into a space defined by an inner peripheral surface of the surface roughening treatment vessel and an outer peripheral surface of the object being treated and to be discharged in a direction turned 180 ° around the longitudinal direction of the surface roughening treatment vessel.

7. The apparatus according to claim 6, further comprising a doughnut-shaped member having a hole capable of receiving the object being treated to permit the same to be inserted centrally of a right end of the surface roughening treatment vessel, and a cone-shaped ring having a side capable of contacting with an edge of the central hole of the doughnut-shaped member, the ring being biased leftward by a compression spring, one end of which is anchored at a block fixed to a right end of a rightward spacer, to abut against the edge of the central hole of the doughnut-shaped member, and forming a seal for magnetic abrasive grains present in the surface roughening treatment vessel at the time of surface roughening treatment, fine powder resulted from the object being treated, at the time of surface roughening treatment, an air which are introduced into a space defined by an inner peripheral surface of the surface roughening treatment vessel and an outer peripheral surface of the object being treated, received in the lumen of the vessel and/or magnetic abrasive grains.

8. The apparatus according to claim 1, further comprising a doughnut-shaped member having a hole capable of receiving the object being treated to permit the same to be inserted centrally of a right end of the surface roughening treatment vessel, and a cone-shaped ring having a side capable of contacting with an edge of the central hole of the doughnut-shaped member, the ring being biased leftward by a compression spring, one end of which is anchored at a block fixed to a right end of a rightward spacer, to abut against the edge of the central hole of the doughnut-shaped member, and forming a seal for magnetic abrasive grains present in the surface roughening treatment vessel at the time of surface roughening treatment, fine powder resulted from the object being treated, at the time of surface roughening treatment, an air which are introduced into a space defined by an inner peripheral surface of the surface roughening treatment vessel and an outer peripheral surface of the object being treated, received in the lumen of the vessel and/or magnetic abrasive grains.

9. A method of performing treatment roughening surfaces of an object being treated, comprising the steps of: applying a three-phase alternating voltage to a rotational magnetic field generating device formed in a two-pole motor/stator to generate a rotational magnetic field, causing magnetic abrasive grains introduced into a surface roughening treatment vessel, which is in the form of a hollow cylinder and arranged in a lumen of the rotational magnetic field generating device, to move at random, and rotating an iron core arranged in a lumen of the surface roughening treatment vessel and causing magnetic abrasive grains to collide against and contact with surfaces of an object being treated, held on an outer surface of the iron core.

10. The method according to claim 9, further comprising introducing a compressed air at many points perpendicularly to an axis of the surface roughening treatment vessel into a space defined by an inner peripheral surface of the surface roughening treatment vessel and an outer peripheral surface of the object being treated, received in the lumen of the vessel, and discharging the air in a position symmetrical about an axis of the object being treated, from the space.

11. The method according to claim 10, further comprising taking out the surface roughening treatment vessel, the object being treated, and the iron core together from the rotational magnetic field generating device in a predetermined time while supplying of electric power to the rotational magnetic field generating device is continued, after termination of the surface roughening treatment.

12. The method according to claim 9, further comprising introducing a rectified air in a direction from one end of the surface roughening treatment vessel toward the other end thereof into a space defined by an inner peripheral surface of the surface roughening treatment vessel and an outer peripheral surface of the object being treated, received in the lumen of the vessel.

13. The method according to claim 12, further comprising taking out the surface roughening treatment vessel, the object being treated, and the iron core together from the rotational magnetic field generating device in a predetermined time while supplying of electric power to the rotational magnetic field generating device is continued, after termination of the surface roughening treatment.

14. The method according to claim 12, wherein introduction of an air into the space defined by the inner peripheral surface of the surface roughening treatment vessel and the outer peripheral surface of the object being treated, received in the lumen of the vessel is intermittently performed.

15. The method according to claim 14, further comprising taking out the surface roughening treatment vessel, the object being treated, and the iron core together from the rotational magnetic field generating device in a predetermined time while supplying of electric power to the rotational magnetic field generating device is continued, after termination of the surface roughening treatment.

16. The method according to claim 9, further comprising taking out the surface roughening treatment vessel, the object being treated, and the iron core together from the rotational magnetic field generating device in a predetermined time while supplying of electric power to the rotational magnetic field generating device is continued, after termination of the surface roughening treatment.

17. The method according to claim 9, further comprising taking out the object being treated, from the surface roughening treatment vessel after termination of the surface roughening treatment, introducing no air into the surface roughening treatment vessel in a state, in which the object being treated is not present in the surface roughening treatment vessel, and applying voltage to the motor/stator of the rotational magnetic field generating device to cause abrasive grains to move at random.

18. The method according to claim 9, further comprising taking out the object being treated, from the surface roughening treatment vessel after termination of the surface roughening treatment, and applying voltage to the motor/stator of the rotational magnetic field generating device to cause abrasive grains to move at random while introducing an air into the surface roughening treatment vessel in a state, in which the object being treated is not present in the surface roughening treatment vessel.

19. The method according to claim 9, wherein the object being treated is a cylinder having been beforehand processed in order to be given an accuracy.

20. The method according to claim 19, wherein the cylinder is a material used for equipments of electrophotography.

* * * * *